US009260898B2

(12) United States Patent
Soma

(10) Patent No.: US 9,260,898 B2
(45) Date of Patent: Feb. 16, 2016

(54) HINGE STRUCTURE

(71) Applicant: NIFCO INC., Yokosuka-shi, Kanagawa (JP)

(72) Inventor: Toshiaki Soma, Yokosuka (JP)

(73) Assignee: NIFCO INC., Yokosuka-Shi, Kanagawa (JP)

( * ) Notice: Subject to any disclaimer, the term of this patent is extended or adjusted under 35 U.S.C. 154(b) by 0 days.

(21) Appl. No.: 14/648,134

(22) PCT Filed: Nov. 28, 2013

(86) PCT No.: PCT/JP2013/006991

§ 371 (c)(1),
(2) Date: May 28, 2015

(87) PCT Pub. No.: WO2014/083855

PCT Pub. Date: Jun. 5, 2014

(65) Prior Publication Data

US 2015/0300063 A1 Oct. 22, 2015

(30) Foreign Application Priority Data

Nov. 29, 2012 (JP) ..... 2012-260738

(51) Int. Cl.
*E05D 7/10* (2006.01)
*H01R 13/52* (2006.01)
*E05D 3/02* (2006.01)

(52) U.S. Cl.
CPC ..... *E05D 7/1055* (2013.01); *E05D 3/022* (2013.01); *E05D 7/105* (2013.01); *H01R 13/5213* (2013.01); *E05D 7/1066* (2013.01); *E05D 7/1077* (2013.01); *E05Y 2900/60* (2013.01)

(58) Field of Classification Search
CPC ..... Y10T 16/53613; Y10T 16/53607; Y10T 16/53615; Y10T 16/5362; E05D 7/12; E05D 7/10; E05D 7/1061; E05D 7/1066; E05D 7/1077; E05D 7/1016; E05Y 2900/602; E05Y 2900/606; B65F 1/16; B65F 1/1646; B65D 43/162–43/167; B65D 43/169; H05K 5/0278; H05K 5/0286; H01R 13/502; H01R 13/665; H01R 13/73; H01R 13/648; H01R 29/00; H01R 29/447; H01R 29/5213
See application file for complete search history.

(56) References Cited

U.S. PATENT DOCUMENTS 782,428 A * 2/1905 Struble et al. ..... E05D 7/1066 16/267
2,734,222 A * 2/1956 Kiba ..... E05D 5/10 16/257

(Continued)

FOREIGN PATENT DOCUMENTS

JP S63-149406 A 6/1988
JP 2002-347997 A 12/2002

(Continued)

OTHER PUBLICATIONS

PCT, "International Search Report for PCT/JP2013/006991".

*Primary Examiner* — Chuck Mah
(74) *Attorney, Agent, or Firm* — Manabu Kanesaka

(57) ABSTRACT

A hinge structure rotatably connects a first member and a second member, and includes a first shaft provided in the first member; a support portion provided in the second member; a bottomed first hole concaved on a side face of the support portion; a second shaft projected on a bottom portion of the first hole; a second hole concaved on an end face of the first shaft, and rotatably receiving an end portion of the second shaft; a first groove concaved on the side face of the support portion and extending in a radial direction of the first hole; and a second groove concaved on the end face of the first shaft and extending in a radial direction of the second hole. When the first member and the second member are assembled, the first shaft passes through the first groove, and the second shaft passes through the second groove.

6 Claims, 10 Drawing Sheets

(56) References Cited

U.S. PATENT DOCUMENTS 2,963,734 A * 12/1960 Huget ..... E05D 7/105 16/266
3,178,761 A * 4/1965 Restaino ..... D05B 75/06 16/257
3,295,713 A * 1/1967 Optner ..... E05D 7/1055 16/257
3,295,714 A * 1/1967 Di Addario ..... E05D 7/1077 16/257
3,333,726 A * 8/1967 Belanger ..... E05D 7/1072 16/257
3,734,222 A * 5/1973 Bardwick, III ..... B60K 6/105 180/165
3,999,876 A * 12/1976 Manchester, Jr. ..... F16G 11/00 16/267
4,701,977 A * 10/1987 Hori ..... B62D 33/033 16/266
4,841,601 A * 6/1989 Taima ..... B60R 7/06 16/361
5,048,715 A * 9/1991 Wolff ..... B65D 43/168 16/267
5,269,046 A * 12/1993 Newby, Sr. ..... E05D 7/1072 16/267
5,316,373 A * 5/1994 Markel ..... A47C 7/543 16/266
6,678,919 B1 * 1/2004 Sokolov ..... E05D 3/04 16/254
6,701,573 B1 * 3/2004 Ciavarella ..... E05D 7/1055 16/257
7,836,549 B1 * 11/2010 McGuigan ..... E05D 7/1072 16/266
7,908,798 B2 * 3/2011 Monneret ..... E02D 29/14 16/267
2004/0111837 A1 * 6/2004 Lallemant ..... G06F 1/1616 16/297
2007/0184709 A1 * 8/2007 Dombrowski ..... G06F 1/1616 439/495
2008/0223601 A1 * 9/2008 Johnson ..... H02G 3/14 174/67

FOREIGN PATENT DOCUMENTS

JP 2008-082442 A 4/2008
JP 2011-51525 A 3/2011
JP 2011-207393 A 10/2011

* cited by examiner

HINGE STRUCTURE

RELATED APPLICATIONS

The present application is National Phase of International Application No. PCT/JP2013/006991 filed Nov. 28, 2013, and claims priority from Japanese Application No. 2012-260738, filed Nov. 29, 2012, the disclosure of which is hereby incorporated by reference herein in its entirety.

FIELD OF TECHNOLOGY

The present invention relates to a hinge structure rotatably connecting a first member and a second member to each other.

BACKGROUND ART

In order to attach a lid closing an opening to a base member including the opening openably and closably, the hinge structure is sometimes used. For example, in Patent Document 1, in order to attach a glove box to an instrument panel openably and closably, there is provided a support shaft in the instrument panel, and there is provided a cylindrical portion (a bearing portion) axially supported by the support shaft in the glove box. In the hinge structure, the cylindrical portion is formed in a C shape including a slit extending in a longitudinal direction. The cylindrical portion elastically deforms in a direction of opening the slit, and can receive the support shaft from a radial direction thereof. Thereby, the glove box and the instrument panel can be assembled by an operation of pushing the glove box to an instrument panel side, so that an assembly work becomes easier.

Also, the hinge structure according to Patent Document 2 includes a pair of support shafts provided coaxially to each other and disposed such that end portions face each other through a predetermined gap; a pair of U-shaped grooves (bearing portions) respectively receiving each support shaft; and a locking piece disposed between the pair of U-shaped grooves, passing through between the pair of support shafts to lock end edges of both support shafts, and having flexibility. When each support shaft is inserted into each U-shaped groove, at least one of each support shaft or the locking piece elastically deforms, and the locking piece passes through between the support shafts. When each support shaft is disposed at a predetermined position of each U-shaped groove, the locking piece returns to an initial shape by an elastic force to lock each support shaft. The locking piece locks each support shaft, so that each support shaft is maintained within the U-shaped groove. As with the hinge structure according to the Patent Document 1, the hinge structure according to the Patent Document 2 can also receive the support shaft in the U-shaped groove from the radial direction thereof so as to have excellent assembly workability.

PRIOR ART DOCUMENT

Patent Document

Patent Document 1: Japanese Unexamined Patent Application Publication No. 2011-51525

Patent Document 2: Japanese Unexamined Patent Application Publication No. 2011-207393

SUMMARY OF THE INVENTION

Problems to be Solved by the Invention

The hinge structures according to the aforementioned Patent Documents 1 and 2, however, have a structure of allowing the support shaft to be inserted to the bearing portion using an elastic deformation, and maintaining the support shaft in the bearing portion by the elastic force, so that when a load is applied, there is a possibility that a connection may be released by the elastic deformation. In such hinge structures, it is difficult to enhance connective stability between the support shaft and the bearing portion while maintaining the assembly workability. For example, in the hinge structure according to the Patent Document 1, the connective stability between the support shaft and the bearing portion can be enhanced by reducing a width of the slit, and increasing an overlap range (an overlap quantity) between both side edges of the cylindrical portion and the support shaft; however, an assembly of the support shaft to the bearing portion becomes difficult. Similarly, in the hinge structure according to the hinge with respect to the Patent Document 2, the connective stability between the support shaft and the bearing portion can be enhanced by increasing the overlap range between the locking piece and both support shafts; however, the assembly of the support shaft to the bearing portion becomes difficult.

The present invention is made in view of the aforementioned backgrounds, and an object of the present invention is that in a hinge structure rotatably connecting the first member and the second member to each other, the first member and the second member can be easily assembled, and the connective stability can be enhanced.

Means for Solving the Problems

In order to obtain the aforementioned object, the present invention is a hinge structure (4) adapted to rotatably connect a first member (3) and a second member (5) to each other. The hinge structure (4) includes a first shaft (22) adapted to be provided in the first member, wherein an end portion thereof becomes a free end; a support portion (38) adapted to be provided in the second member to support the first shaft; a bottomed first hole (41) concaved on a side face (39) of the support portion, and rotatably receiving the end portion of the first shaft; a second shaft (51) projecting from a bottom portion (42) of the first hole; a second hole (26) concaved on an end face (24) of the first shaft, and rotatably receiving an end portion of the second shaft; a first groove (45) concaved on the side face of the support portion, extending in a radial direction of the first hole from the first hole, and opening at an end portion; and a second groove (29) concaved on the end face of the first shaft, extending in a radial direction of the second hole from the second hole, and opening at an end portion. When the first member and the second member are assembled to each other, the first shaft passes through the first groove to be disposed in the first hole, and the second shaft passes through the second groove to be disposed in the second hole.

According to the structure, only in a case wherein an extending direction of the first groove and an extending direction of the second groove correspond, the first shaft can be detached from the first hole, and the second shaft can be detached from the second hole. On the other hand, in a case wherein the extending direction of the first groove and the extending direction of the second groove do not correspond, the second shaft abuts against a hole wall of the second hole so as to block the first shaft from moving in a direction along the first groove, and the first shaft abuts against a hole wall of the first hole so as to block the second shaft from moving in a direction along the second groove. Consequently, the first member and the second member can be separated only when a mutual relative angle has a predetermined value, and at another angle, they cannot be separated. Thereby, except for when the relative angle of the first member and the second member has the predetermined value, connective stability of the hinge structure improves. Also, in the case wherein the extending direction of the first groove and the extending direction of the second groove correspond, insertion of the first shaft into the first hole by passing through the first groove, and insertion of the first shaft into the first hole by passing through the first groove are easy, so that an assembly work of the first member and the second member becomes easier.

In the aforementioned invention, there may be further included a locking convex portion protruding from a bottom portion of the second groove, and locking an edge portion of the second shaft.

According to the structure, the locking convex portion locks the second shaft, and fastens the second shaft to the second hole, so that in the case wherein the extending direction of the first groove and the extending direction of the second groove correspond, the second shaft is prevented from being detached from the second hole unintentionally. Namely, in the case wherein the extending direction of the first groove and the extending direction of the second groove correspond, it is prevented that the first member and the second member separate from each other unintentionally.

In the aforementioned invention, the first groove may have a width smaller than a diameter of the first shaft at one portion, and the first groove may elastically deform to allow the first shaft to pass through. Incidentally, the first groove has the width smaller than the diameter of the first shaft at one portion, so that a convex portion may be included on a wall face, and the convex portion may project (bulge) in such a way that the wall face narrows the width.

According to the structure, the first groove provides a resistance force relative to the passing of the first shaft, so that the first shaft is fastened inside the first hole. Thereby, in the case wherein the extending direction of the first groove and the extending direction of the second groove correspond, the first shaft is prevented from being detached from the first hole unintentionally.

In the aforementioned invention, the second groove may have a width smaller than a diameter of the second shaft at one portion, and the second groove may elastically deform to allow the second shaft to pass through. Incidentally, the second groove has the width smaller than the diameter of the second shaft at one portion, so that a convex portion may be included on a wall face, and the convex portion may project (bulge) in such a way that the wall face narrows the width.

According to the structure, the second groove provides a resistance force relative to the passing of the second shaft, so that the second shaft is fastened inside the second hole. Thereby, in the case wherein the extending direction of the first groove and the extending direction of the second groove correspond, the second shaft is prevented from being detached from the second hole unintentionally.

In the aforementioned invention, there may be further included a rib (55) projected on the bottom portion of the first hole, and slidingly contacting with the end face of the first shaft.

According to the structure, the end face of the first shaft avoids contact with a bottom face of the first hole, and slidingly contacts with the rib so as to reduce a contact area of the end face of the first shaft, and reduce a frictional resistance accompanied by a rotation of the hinge structure. Also, a movement in a shaft line direction of the first shaft is restricted by abutting against the rib, so that wobbling of the first member and the second member in the shaft line direction of the first shaft is reduced. Due to these functions, a rotation movement of the hinge structure becomes smooth.

In the aforementioned invention, the first shaft, the second shaft, the first hole, and the second hole may be disposed on one shaft line.

According to the structure, a rotation shaft of the hinge structure is fixed at one, and the rotation movement of the hinge structure becomes smooth.

Effect of the Invention

According to the aforementioned structure, in the hinge structure rotatably connecting the first member and the second member to each other, the first member and the second member can be easily assembled, and the connective stability can be enhanced.

BEST MODES OF CARRYING OUT THE INVENTION

Hereinafter, with reference to the drawings, an embodiment wherein a hinge structure according to the present invention is applied to a connector holder will be explained in detail.

Figure 1:
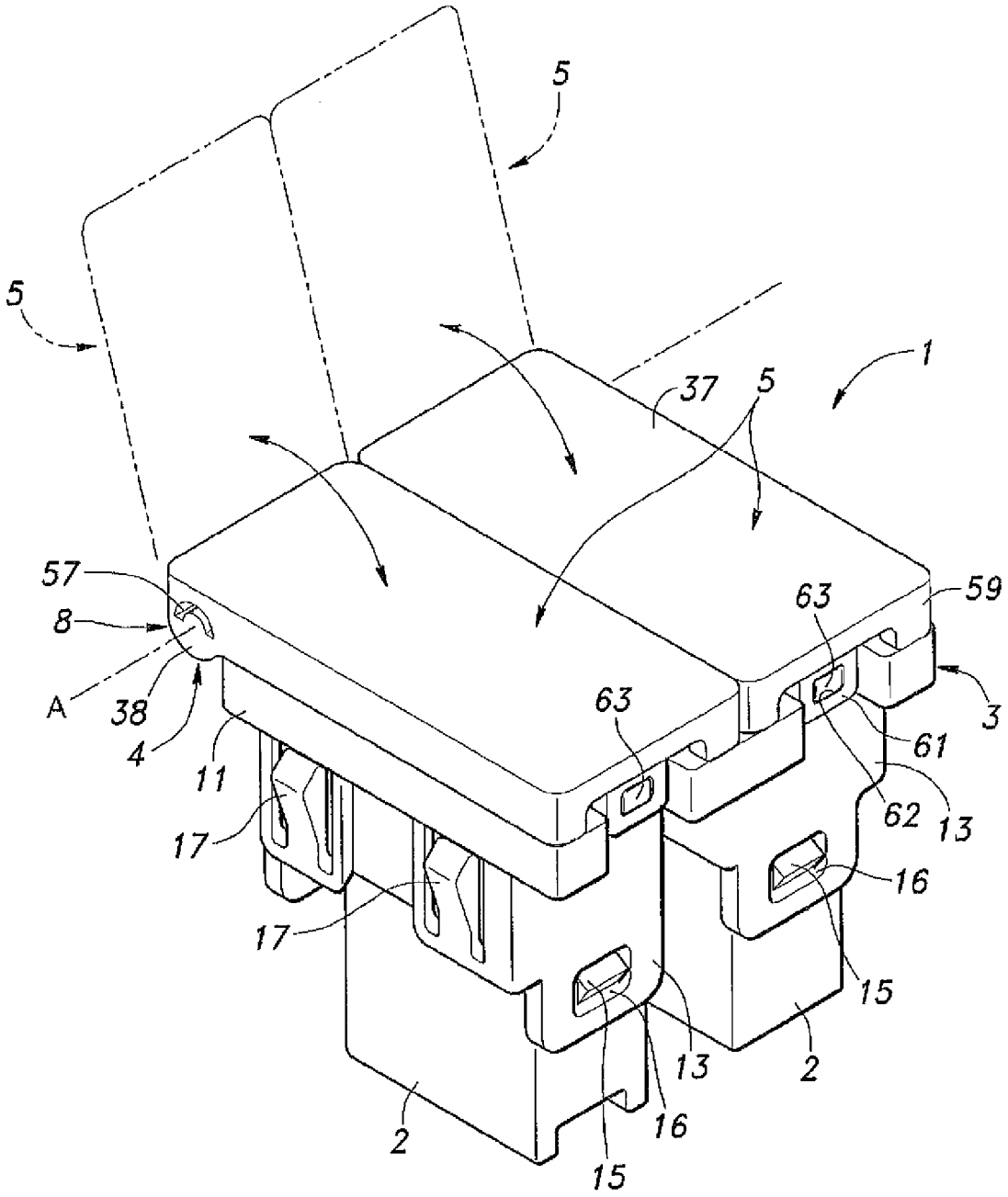
FIG. 1 is a perspective view of a connector holder according to an embodiment.
Figure 2:
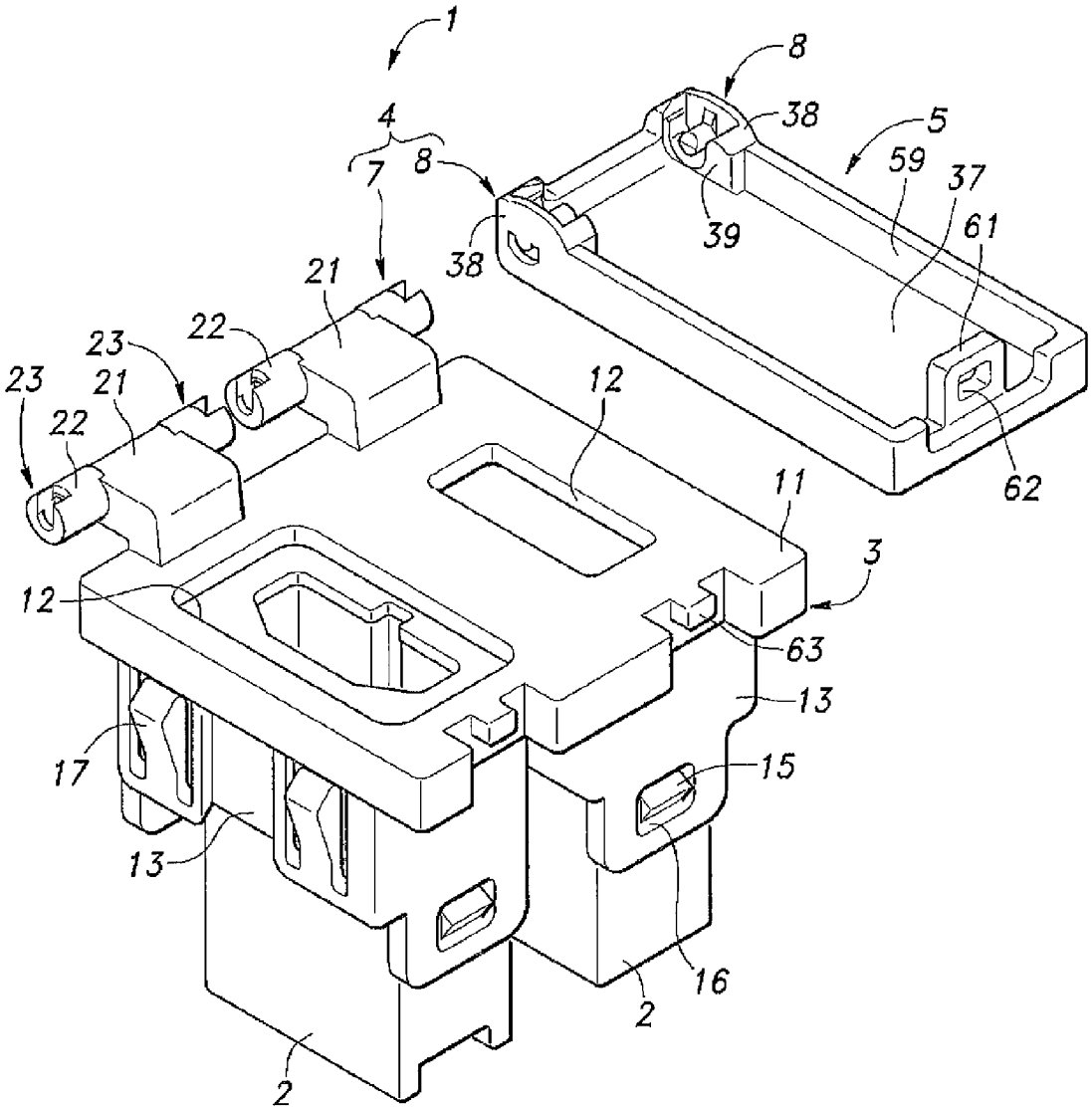
FIG. 2 is an exploded perspective view of the connector holder according to the embodiment.

FIG. 1 is a perspective view of the connector holder according to the embodiment, and FIG. 2 is an exploded perspective view of the connector holder according to the embodiment. The connector holder 1 shown in FIG. 1 and FIG. 2 supports connectors 2 (couplers) such as, for example, USB or HDMI (registered trademarks), or the like in an instrument panel (not shown in the drawings), and exposes terminal portions of the connectors 2 to an intra-vehicle side of the instrument panel. The connector holder 1 includes a holder main member 3 attached to the instrument panel and supporting the connectors 2; and two holder lids 5 rotatably supported by the holder main member 3 through a hinge structure 4 respectively to cover the terminal portions of the connectors 2. The hinge structure 4 includes a main member side portions 7 integrally provided in the holder main member 3, and a lid side portion 8 integrally provided in the holder lid 5. The holder main member 3 and the holder lid 5 are formed by known thermoplastic resin material such as, for example, polypropylene and the like by injection molding.

In the instrument panel, there is formed an attachment hole (not shown in the drawings) opening in a thickness direction. A main member of the connector 2 includes a plate-like base plate portion 11 covering the attachment hole from the intra-vehicle side. The base plate portion 11 is formed larger than the attachment hole so that the base plate portion 11 cannot pass through the attachment hole.

In the base plate portion 11, there are formed two through-holes 12 corresponding to shapes of the terminal portions of the connectors 2. On a rear face of the base plate portion 11, there are projected holding portions 13 in such a way as to surround each of the through-holes 12. The holding portion 13 forms a cylindrical shape having a square cross-sectional shape wherein both ends thereof are open, and one end is communicated with the through-hole 12. Shapes of each of the through-holes 12 and each of the holding portions 13 are appropriately selected in accordance with a type of the connector 2 such as the USB and the like. The connector 2 is inserted into each of the holding portions 13 in such a way that the terminal portion of the connector 2 is exposed from the through-hole 12. On a side portion of each holding portion 13, there is formed a locking hole 16 with which a claw 15 projected on an outer face of the connector 2 engages, and the claw 15 and the locking hole 16 are engaged, so that the connector 2 is fixed into the holding portion 13.

The two holding portions 13 pass through the attachment hole of the instrument panel so as to protrude to a rear face side of the instrument panel. On the side portion of the holding portion 13, there are provided elastic claws 17 having flexibility to be displaceable in an inside-outside direction of the holding portion 13. When the holding portion 13 is inserted into the attachment hole, the elastic claw 17 enters into the holding portion 13 so as to allow the holding portion to be inserted into the attachment hole, and after the insertion is completed, the elastic claw 17 protrudes outside the holding portion 13 so as to be caught in a hole edge of the attachment hole and prevent the holding portion 13 from coming out of the attachment hole.

The two holder lids 5 are provided corresponding to each of the through-holes 12, and open and close each through hole independently of each other. The two holder lids 5 are formed in the same shape, and the hinge structures 4 connecting each of the holder lids 5 to the holder main member 3 are formed in the same shape as well. In the holder main member 3, there are provided two main member side portions 7 of the hinge structures 4, and in each of the holder lids 5, there is provided one lid side portion 8 of the hinge structure 4, respectively.

Figure 3:
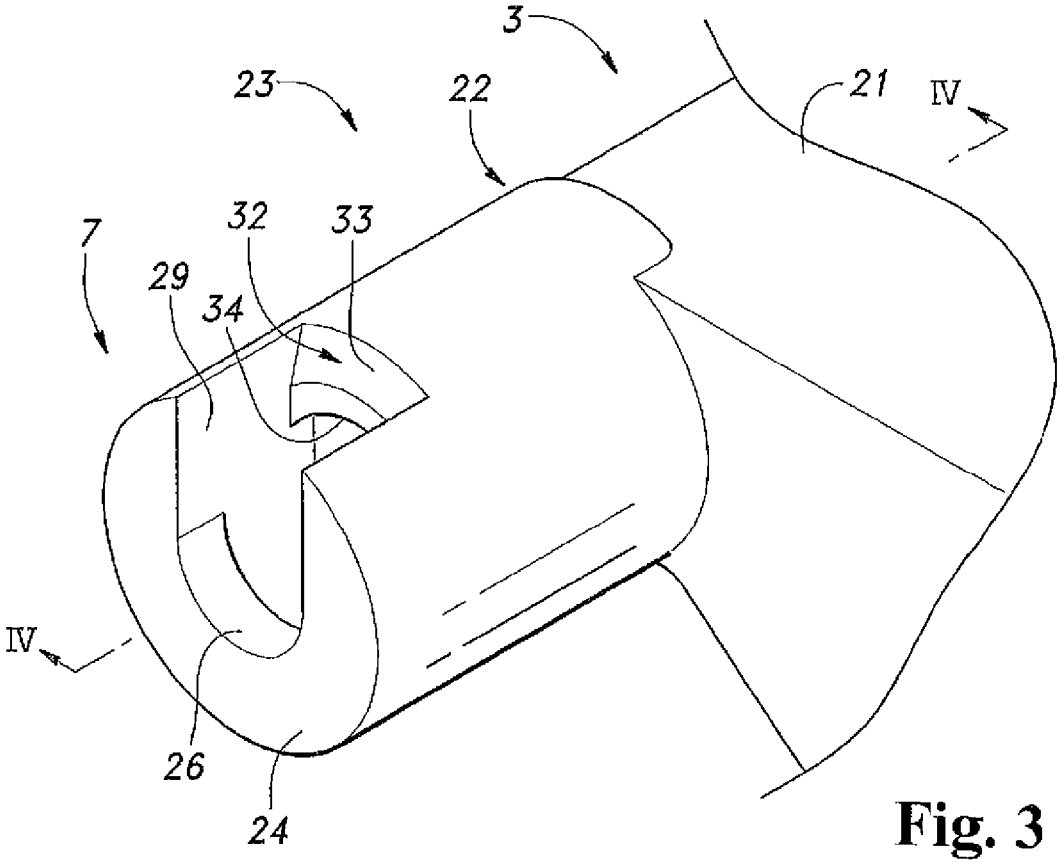
FIG. 3 is a perspective view of a main member side portion of a hinge structure.
Figure 4:
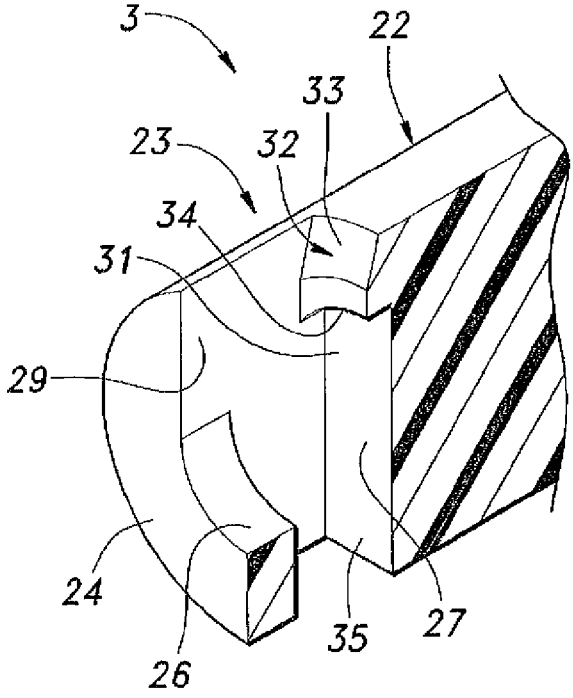
FIG. 4 is a cross-sectional view taken along a line IV-IV in FIG. 3.

FIG. 3 is a perspective view of the main member side portion 7 of the hinge structure 4, and FIG. 4 is a cross-sectional view taken along a line IV-IV in FIG. 3. As shown in FIG. 2 to FIG. 4, the main member side portion 7 of the hinge structure 4 includes a shaft support portion 21 projected in the base plate portion 11, and a columnar first shaft 22 supported by the shaft support portion 21. The first shaft 22 is supported by the shaft support portion 21 at an intermediate portion in a longitudinal direction, and both end portions 23 are free ends. Namely, the first shaft 22 protrudes from the shaft support portion 21 in a direction opposite to the shaft support portion 21 to each other so as to form the end portions 23. In the first shaft 22, a shaft line thereof is approximately parallel to a surface of the base plate portion 11, and the first shaft 22 is disposed apart from the base plate portion 11.

Both end portions 23 of the first shaft 22 have the same shape, so that in the following explanation, one of the end portions 23 will be explained. A first end face 24 forming an end face of the end portion 23 of the first shaft 22 has a flat face orthogonal to the shaft line of the first shaft 22. At a center portion of the first end face 24, there is formed a second hole 26 (a first hole 41 will be described later) which is a bottomed hole having a circular cross-sectional shape coaxially with the shaft line of the first shaft 22. The second hole 26 includes a second-hole bottom face 27 forming a face orthogonal to the shaft line of the first shaft 22 on a bottom portion.

In the first end face 24, there is concaved a second groove 29 (a first groove 45 will be described later) wherein one end thereof continues to the second hole 26, and linearly extends along one direction in a radial direction of the first shaft 22 (the second hole 26), and the other end thereof opens on a circumferential surface of the first shaft 22. In the present embodiment, the second groove 29 extends to a side opposite to the base plate portion 11 from the second hole 26. A width (a length in a direction orthogonal to an extending direction) of the second groove 29 is formed in the same size as a diameter of the second hole 26. Thereby, when viewed from a shaft line direction of the first shaft 22, edges of the second hole 26 and the second groove 29 respectively form a U shape together. It can be said that the second hole 26 forms one end portion of the second groove 29.

On a bottom portion of the second groove 29, there is formed a second-groove bottom portion 31 continuing to the second hole bottom face 27 and forming the same surface. In the second-groove bottom portion 31, there is formed a locking convex portion 32 protruding to a first end face 24 side. The locking convex portion 32 includes an inclined face 33 wherein a protruding length thereof increases as moving to a center side of the first shaft 22 outside in the radial direction of the first shaft 22; and a locking face 34 forming a circumferential surface around the first shaft 22 inside in the radial direction of the first shaft 22.

In the present embodiment, there is formed a lightening hole 35 passing through on the circumferential surface of the first shaft 22 from a wall face of the second hole 26 facing the locking convex portion 32 in the radial direction. The lightening hole 35 in the present embodiment is provided to pass through a die forming the locking face 34 of the locking convex portion 32 at a time of forming the holder main member 3.

As shown in FIG. 2, the holder lid 5 includes a lid plate portion 37 forming an appropriately rectangular plate shape. The lid side portions 8 of the hinge structure 4 include a pair of support walls (support portions) 38, and the respective support walls 38 are disposed on both ends (adjacent corner portions of the lid plate portion 37) of one side edge of the lid plate portion 37. The support walls 38 face each other and have symmetrical shapes. In the following explanation, one support wall 38 will be explained. The support wall 38 is projected on a rear face of the lid plate portion 37, and includes a side face 39 which becomes vertical relative to the rear face of the lid plate portion 37. On the side face 39, the pair of support walls 38 faces each other.

Figure 5:
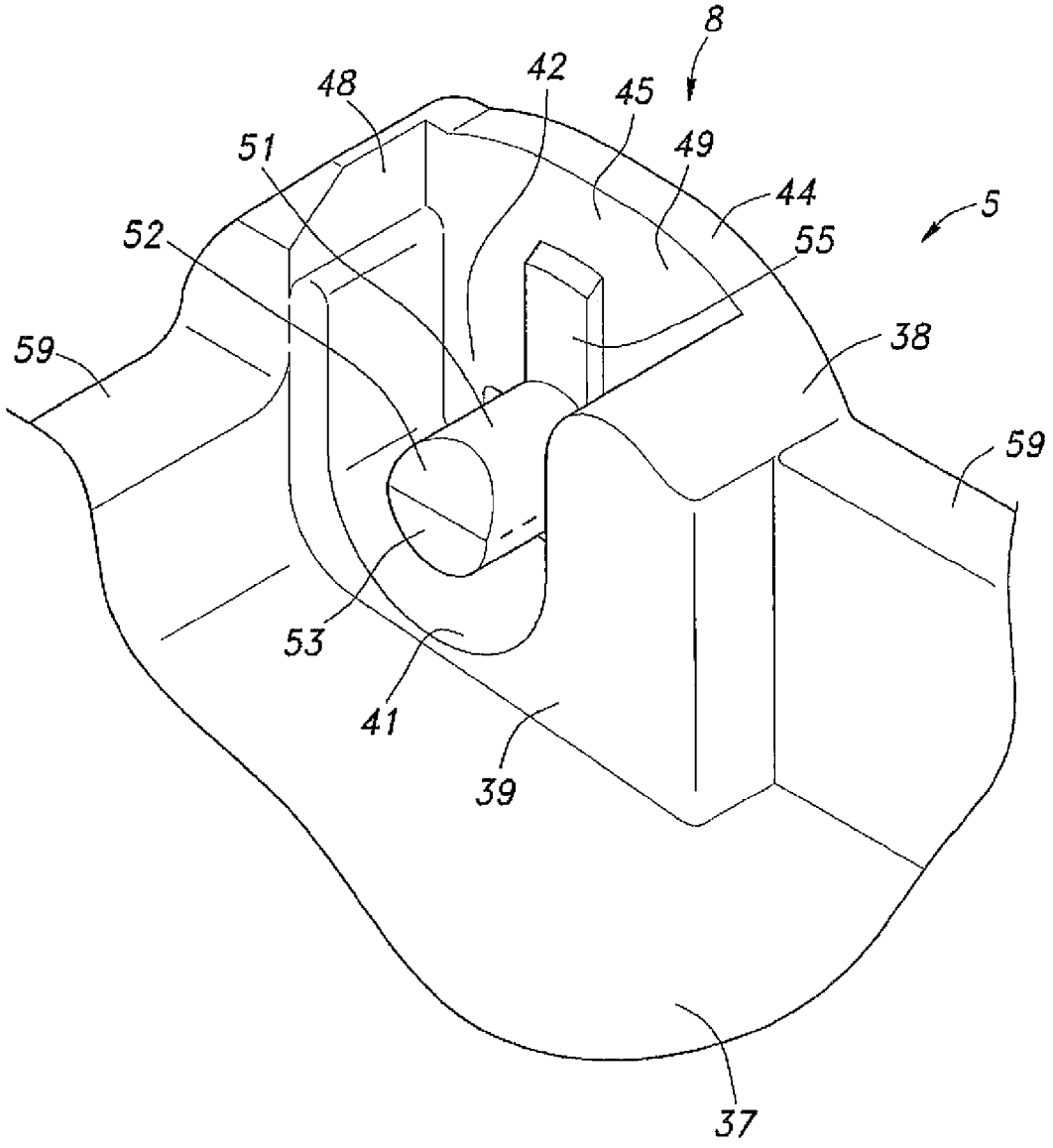
FIG. 5 is a perspective view of a lid side portion of the hinge structure.
Figure 6:
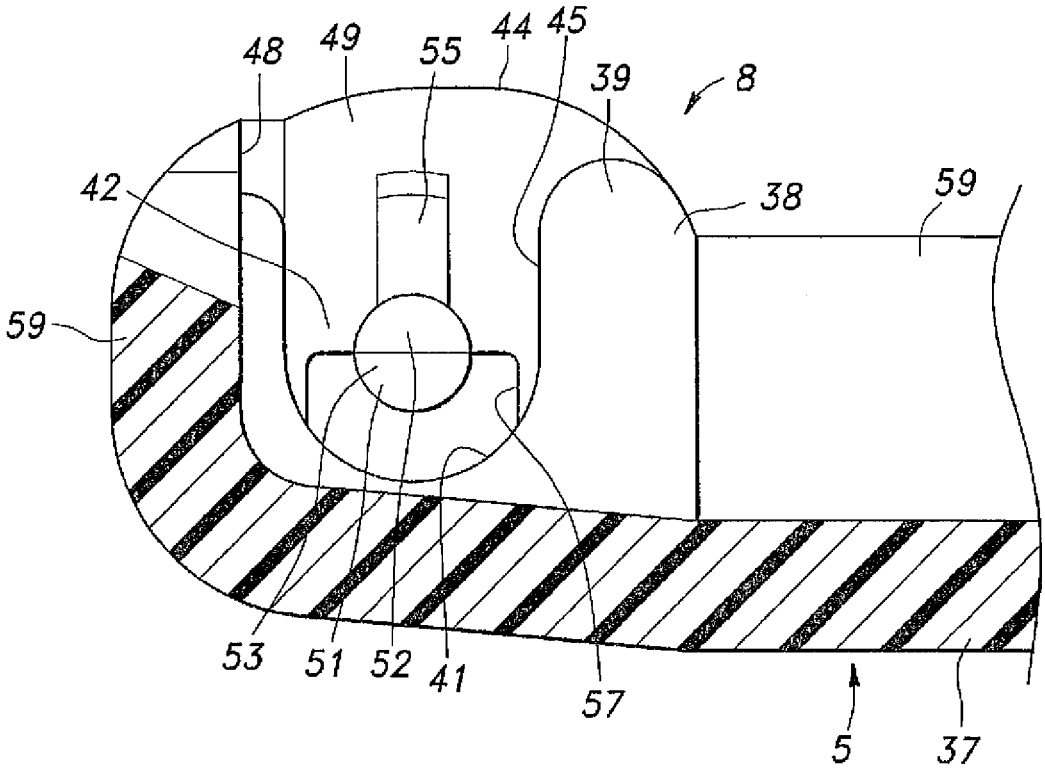
FIG. 6 is a side view of the lid side portion of the hinge structure.

FIG. 5 is a perspective view of the lid side portion 8 of the hinge structure 1, and FIG. 6 is a side view of the lid side portion 8 of the hinge structure 1. As shown in FIG. 5 and FIG. 6, on the side face 39 of the support wall 38, there is formed a first hole 41 which is a bottomed hole having a circular cross-sectional shape wherein a shaft line thereof becomes vertical to the side face 39. The first hole 41 includes a first-hole bottom face 42 parallel to the side face 39 on a bottom portion. A diameter of the first hole 41 is formed larger than a diameter of the first shaft 22, and it is preferable that the diameter of the first hole 41 is slightly larger than the diameter of the first shaft 22. The first hole 41 rotatably receives the end portion 23 of the first shaft 22.

On the side face 39, there is concaved the first groove wherein one end thereof continues to the first hole 41; linearly extending along one direction in a radial direction of the first hole 41; and wherein the other end thereof opens on a protruding end face 44 orthogonal to the side face 39 of the support wall 38. In other words, it can be said that the first hole 41 forms one end portion of the first groove 45. In the present embodiment, the first groove 45 extends to a side opposite to the lid plate portion 37 from the first hole 41, and opens on the protruding end face 44 of the support wall 38. A width (the length in the direction orthogonal to the extending direction) of the first groove 45 is formed in the same size as a diameter of the first hole 41. Thereby, when viewed from a shaft line direction of the first hole 41, edges of the first hole 41 and the first groove 45 respectively form a U shape together. The first groove 45 includes a widening portion 48 widening relative to other portions at an end portion on a protruding end face 44 side. Wall faces between the widening portion 48 and the other portions of the first groove 45 continues by inclined faces. On a bottom portion of the first groove 45, there is formed a first-groove bottom face 49 continuing to the first-hole bottom face 42, and forming the same surface.

At a center portion of the first-hole bottom face 42, there is projected a columnar second shaft 51 coaxially with the first hole 41. A diameter of the second shaft 51 is formed to be smaller than the diameter of the second hole 26. It is preferable that the diameter of the second shaft 51 is slightly smaller than that of the second hole 26. A half portion on the protruding end face 44 side in a tip portion of the second shaft 51 is an inclined face 52 so that a protruding length of the second shaft 51 becomes shorter as moving to the protruding end face 44 side. On the other hand, the side opposite to the inclined face 52 in the tip portion of the second shaft 51 becomes a second end face 53 forming a flat surface orthogonal to a shaft line of the second shaft 51. In the first-hole bottom face 42 and the first-groove bottom face 49, there is formed a rib 55 linearly extending to the protruding end face 44 side from a portion on the protruding end face 44 side in a base portion of the second shaft 51. In the rib 55, a protruding end in a shaft line direction of the second shaft 51 has an approximately flat surface shape.

In the present embodiment, in a portion opposite to the protruding end face 44 side around the second shaft 51 of the first-hole bottom face 42, there is formed a second lightening hole 57 passing through on an outer face (a face on a side opposite to the side face 39) of the support wall 38. The second lightening hole 57 in the present embodiment is provided to pass through a die forming a portion on the side opposite to the protruding end face 44 side of the second shaft 51 at a time of forming the holder lid 5.

In the pair of support walls 38, the second shaft 51, the second hole 26, and the second groove 29 face each other, and the pair of support walls 38 is disposed in the lid plate portion 37 so that distances between the respective second shaft 51, second hole 26, and second groove 29 and the rib 55 are larger than a length in the longitudinal direction of the first shaft 22. On the rear face of the lid plate portion 37, there extend edge walls 59 protruding in the same direction as the support walls 38 along edges of the lid plate portion 37. As shown in FIG. 1 and FIG. 2, locking pieces 61 are projected at a side edge portion facing a side edge portion where the pair of support walls 38 of the lid plate portion 37 is provided. At each of center portions of the locking pieces 61, there are formed locking holes 62 passing through in a thickness direction. Locking projections 63 are projected at a side edge portion facing a side edge portion where the shaft support portions 21 of the base plate portion 11 are provided. When the holder lid 5 is assembled to the holder main member 3 and positioned in a closed position of covering the through-holes 12, the locking projections 63 lock the locking holes 62 of the locking pieces 61. The holder lid 5 is maintained in the closed position by an engagement between the locking pieces 61 and the locking projections 63.

Figure 7:
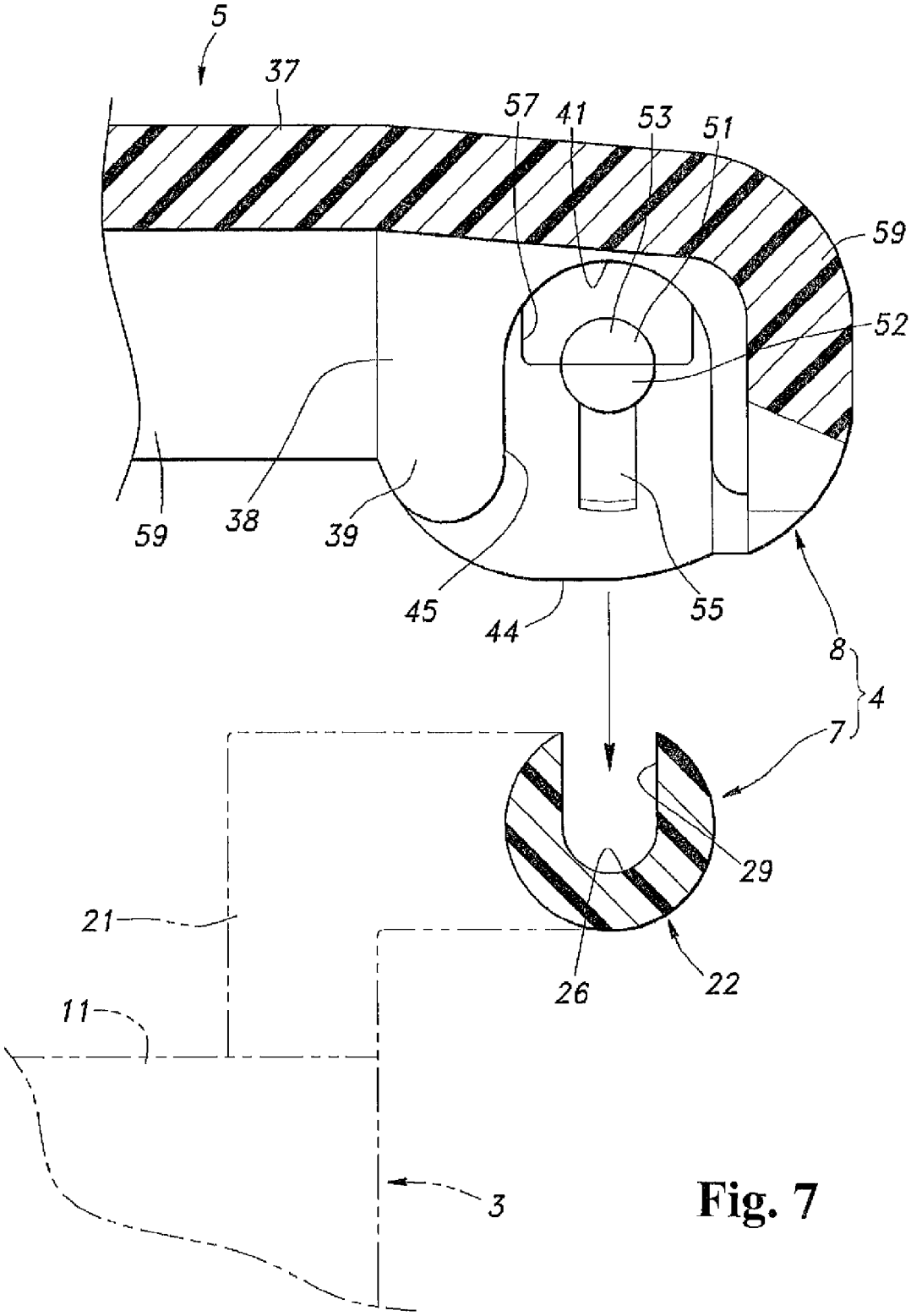
FIG. 7 is a cross-sectional view showing a positional relationship when a holder main member and a holder lid are assembled.

Next, an assembly procedure of the holder main member 3 and the holder lid 5 will be explained. FIG. 7 is a cross-sectional view showing a positional relationship when the holder main member 3 and the holder lid 5 are assembled. First, as shown in FIG. 7, the holder main member 3 and the holder lid 5 are disposed so that the rear face of the lid plate portion of the holder lid 5 faces the surface of the base plate portion 11 of the holder main member 3. At that time, the shaft lines of first shaft 22 and the pair of second shafts 51 are disposed in parallel to one another, and the extending direction (a direction of extending to the protruding end face 44 of the support wall 38 from the first hole 41) of the first groove 45, and the extending direction (a direction of extending to the circumferential surface of the first shaft 22 from the second hole 26) of the second groove 29 are disposed to correspond to each other.

Figure 8:
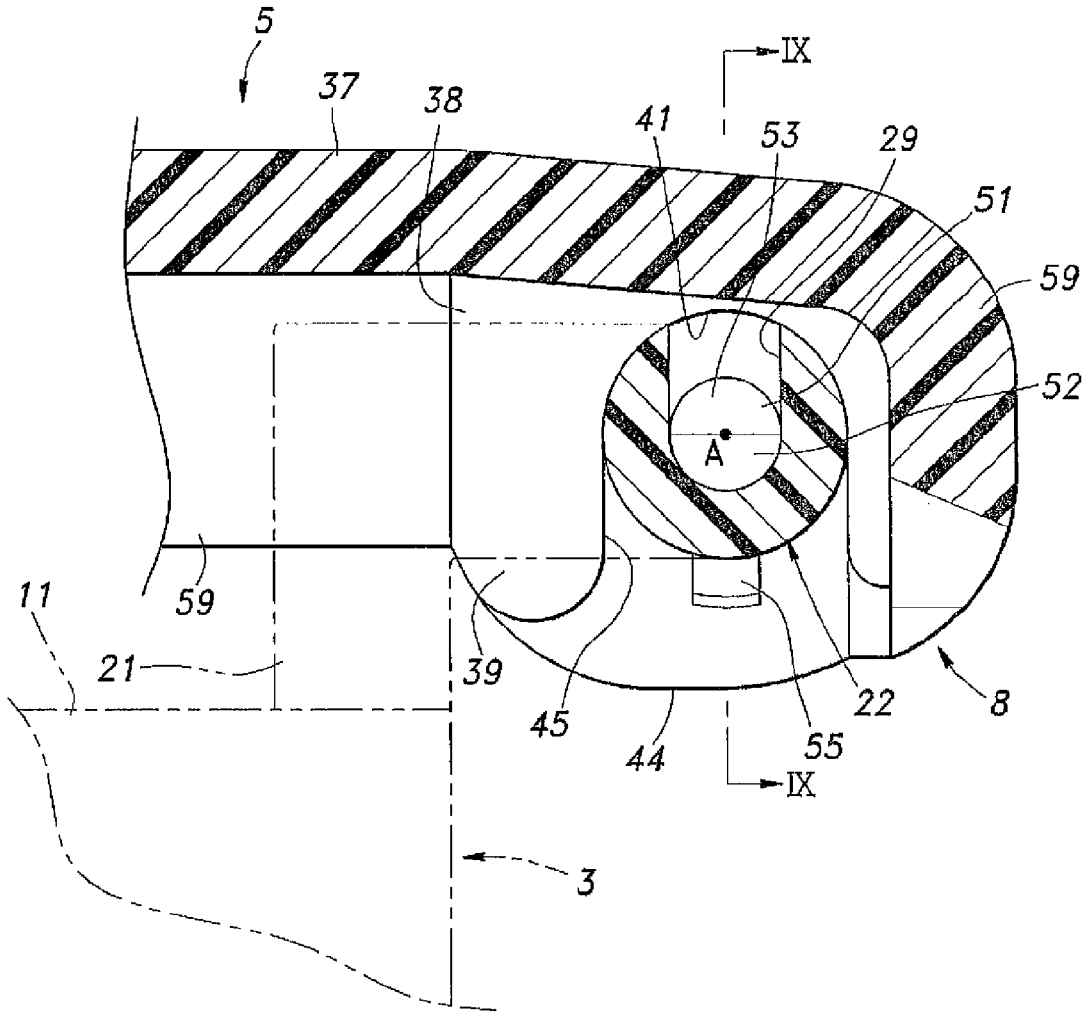
FIG. 8 is a cross-sectional view showing a positional relationship when the holder main member and the holder lid are completed to be assembled.

From a state shown in FIG. 7, when the holder main member 3 and the holder lid 5 approach each other while maintaining a state wherein the extending direction of the first groove 45 and the extending direction of the second groove 29 correspond, the end portions 23 of the first shaft 22 are respectively inserted into the pair of respective first grooves 45 from the radial direction. Simultaneously, the second shafts 51 are respectively inserted into the respective second grooves 29 from the radial direction. From this state, when the holder main member 3 and the holder lid 5 approach each other further, as shown in FIG. 8, the first shaft 22 moves inside the first groove 45 to reach a first hole 41 side, and the second shaft 51 moves inside the second groove 29 to reach the second hole 26. FIG. 8 is a cross-sectional view showing a positional relationship when the holder main member 3 and the holder lid 5 are completely assembled.

Figure 9:
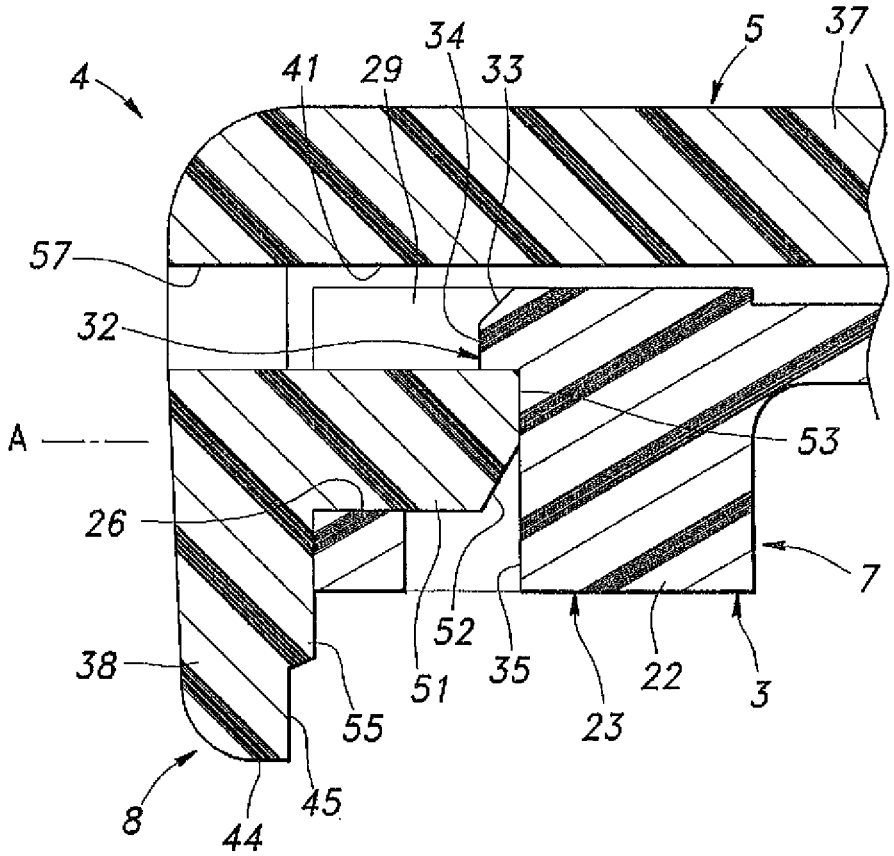
FIG. 9 is a cross-sectional view taken along a line IX-IX in FIG. 8.

In a process wherein the second shaft 51 moves inside the second groove 29, the second shaft 51 climbs over the locking convex portion 32. The inclined face 52 of the second shaft 51 and the inclined face 33 of the locking convex portion 32 are provided to make the second shaft 51 easy to climb on the locking convex portion 32. When the second shaft 51 passes through the locking convex portion 32, at least one of the second shaft 51, the support wall 38, the lid plate portion 37, and the first shaft 22 elastically deforms, and after the second shaft 51 passes through the locking convex portion 32, the aforementioned elastic deformation is restored. FIG. 9 is a cross-sectional view taken along a line IX-IX in FIG. 8, and shows a positional relationship to the locking convex portion when the second shaft 51 is positioned inside the second hole 26. As shown in FIG. 9, the locking convex portion 32 engages with a circumferential portion of the second shaft 51 from the radial direction to prevent the second shaft 51 from moving from the second hole 26 to a second groove 29 side.

As shown in FIG. 8, approaching of the holder main member 3 and the holder lid 5 finishes in a state wherein the first shaft 22 is disposed inside the first hole 41, and the second shaft 51 is disposed inside the second hole 26. In that state, the first shaft 22 is rotatably received in the first hole 41, and the second shaft 51 is rotatably received in the second hole 26. At that time, shaft lines of the first shaft 22, the first hole 41, the second shaft 51, and the second hole 26 are disposed on a common shaft line A. The shaft line A becomes a rotation center of the hinge structure 4. Thereby, the holder lid 5 is supported rotatably around the shaft line A relative to the holder main member 3 through the hinge structure 4. The holder lid 5 can rotate between the closed position wherein the lid plate portion 37 is disposed along the base plate portion 11 to cover the through-hole 12, and an open position wherein the lid plate portion 37 is apart from the base plate portion 11 (see FIG. 1). At that time, the first end face 24 of the first shaft 22 slidingly contacts with the rib 55. The first end face 24 slidingly contacts with the rib 55 so as to reduce a contact area between the first shaft 22 and the lid side portion 8 and control a relative movement of the main member side portion 7 and the lid side portion 8 in a shaft line A direction.

In the closed position, the locking projection 63 of the holder main member 3 is locked in the locking hole 62 of the locking piece 61 of the holder lid 5, and the holder lid 5 is maintained in the closed position. The open position is determined by the edge wall 59 of the lid plate portion 37 colliding with an edge portion of the base plate portion 11.

Effects of the connector holder 1 formed as above will be explained. In the hinge structure 4 in the connector holder 1, there are provided the first groove 45 and the second groove 29, so that the first shaft 22 can be inserted into the first hole 41 from the radial direction thereof, and the second shaft can be inserted into the second hole 26 from the radial direction thereof. Namely, the first member and the second member can be assembled from the radial direction (a direction orthogonal to the shaft line A) of the shaft line A which becomes the rotation center, and an assembly work is easy.

Figure 10:
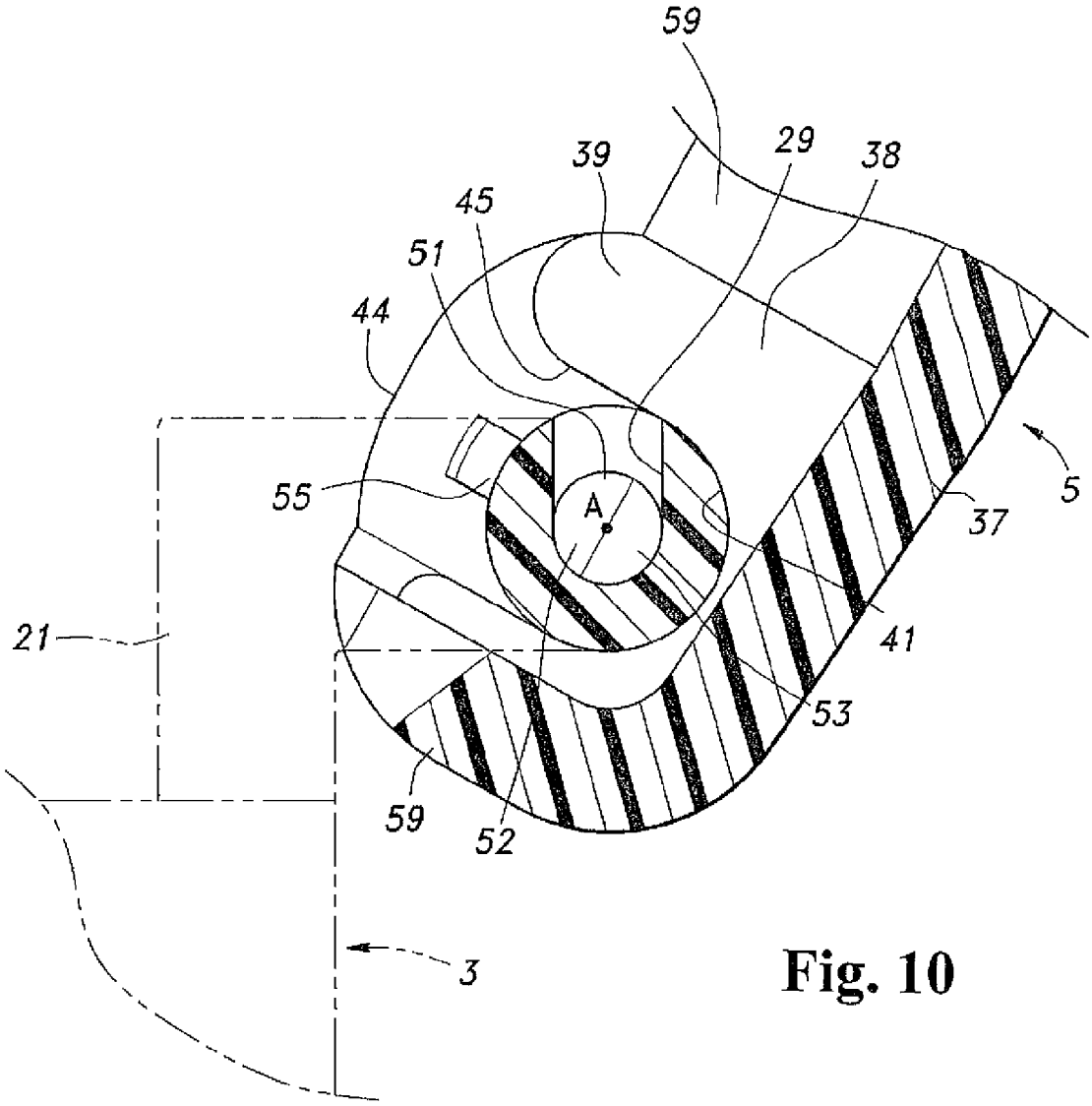
FIG. 10 is a cross-sectional view showing the hinge structure in an open position.

Also, only when the extending direction of the first groove 45 and the extending direction of the second groove 29 correspond, the first shaft 22 can be inserted into or pulled out of the first hole 41, and the second shaft 51 can be inserted into or pulled out of the second hole 26. FIG. 10 is a cross-sectional view showing the hinge structure 4 in the open position. As shown in FIG. 10, when the holder lid 5 is rotated from the closed position, the extending direction of the first groove 45 and the extending direction of the second groove 29 intersect. In that state, a movement in a direction along the first groove 45 of the first shaft 22 is inhibited by the second shaft 51 colliding with the hole wall of the second hole 26. Similarly, a movement in a direction along the second groove 29 of the second shaft 51 is inhibited by the first shaft 22 colliding with the hole wall of the first hole 41. Thereby, the hinge main member and the hinge lid cannot be attached/detached except for a predetermined rotational angle so as to improve connective stability of the hinge main member and the hinge lid. In the present embodiment, only when the hinge lid is positioned in the closed position, the hinge main member and the hinge lid can be attached/detached.

In the hinge structure 4 according to the present embodiment, when the extending direction of the first groove 45 and the extending direction of the second groove 29 correspond, the first shaft 22 can be easily inserted into the first hole 41 through the first groove 45, and the second shaft 51 can be easily inserted into the second hole 26 through the second groove 29. Consequently, a holding range in the shaft line direction of the first shaft 22 by the first hole 41 can be enlarged. Thereby, holding stability of the first shaft 22 by the first hole 41 can be improved further. Similarly, the holding range in the shaft line direction of the second shaft 51 by the second hole 26 can be enlarged so as to enhance the holding stability of the second shaft 51 by the second hole 26.

The locking convex portion 32 locks the circumferential portion of the second shaft 51 to prevent the second shaft 51 from moving from the second hole 26 to the second groove 29. Thereby, in the closed position wherein the extending direction of the first groove 45 and the extending direction of the second groove 29 correspond, the second shaft 51 is prevented from being detached from the second hole 26, and simultaneously, the first shaft 22 is prevented from being detached from the first hole 41. Namely, even in a case wherein the extending direction of the first groove 45 and the extending direction of the second groove 29 correspond, a separation between the main member side portion 7 and the lid side portion 8 is prevented.

Figure 11:
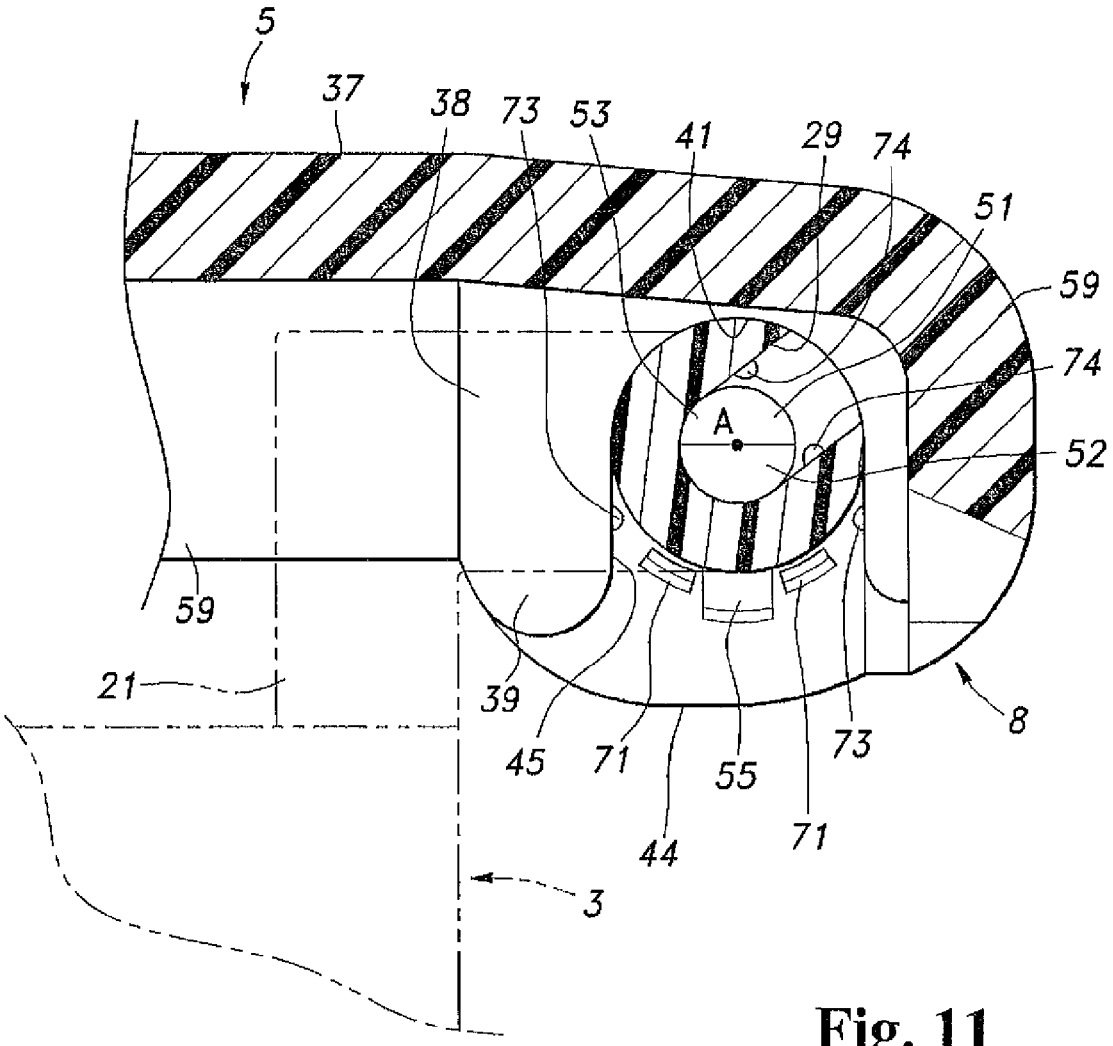
FIG. 11 is a cross-sectional view showing an embodiment in a closed position of the hinge structure according to a modified embodiment.

A specific embodiment has been explained in the above; however, the present invention is not limited to the aforementioned embodiment, and can be extensively modified. For example, in the aforementioned embodiment, the extending direction of the first groove 45 and the extending direction of the second groove 29 correspond in the closed position; however, when they correspond, a rotational angle of the holder lid 5 may be arbitrarily set. For example, when the holder lid 5 is positioned in the open position, the extending direction of the first groove 45 and the extending direction of the second groove 29 may correspond. Also, regarding an angle (i.e., an arbitrary rotational angle between the closed position and the open position) where the holder lid 5 is positioned during rotation, the extending direction of the first groove 45 and the extending direction of the second groove 29 may correspond. FIG. 11 is a cross-sectional view showing an embodiment of the hinge structure in the closed position according to a modified embodiment. As shown in FIG. 11, the first groove 45 may extend by inclining from a direction orthogonal to the surface of the base plate portion 11. In that case, the extending direction of the first groove 45 and the extending direction of the second groove 29 correspond at an angle where the holder lid 5 is positioned during rotation at opening and closing times. Regarding the angle where the holder lid 5 is positioned during rotation, when using, the holder lid 5 has few opportunities of being maintained at the angle thereof so as to reduce opportunities wherein the main member side portion 7 and the lid side portion 8 become separable.

The locking convex portion 32 may be omitted in another embodiment. Also, a locking convex portion 71 may be provided in the first-groove bottom face 49 to lock a circumferential portion of the first hole 41 by the locking convex portion 71. The locking convex portion 71 prevents the first shaft 22 from moving along the first groove 45 to maintain the first shaft 22 inside the first hole 41.

As shown in FIG. 11, on wall portions of the first groove 45, there may be provided flexible convex portions 73 which narrow the width of the first groove 45. The convex portions 73 may be provided on respective walls of the first groove 45 facing each other. The convex portions 73 may project (may bulge) from wall faces of the first groove 45 with a smooth outer shape in such a way as to form an outer face continuing to an inner circumferential surface of the first hole 41. Each of the convex portions 73 locks an outer circumferential portion of the first shaft 22 to prevent the first shaft 22 from moving to the first groove 45 from the first hole 41. When the first shaft 22 is inserted into the first hole 41 by passing through the first groove 45, the convex portion 73 and the first groove 45 elastically deform so as to allow the first shaft 22 to pass through. Similarly, on wall portions of the second groove 29, there may be provided flexible convex portions 74 narrowing the width of the second groove 29 to prevent the second shaft 51 from moving from the second hole 26 to the second groove 29 by the convex portion 74.

Also, the embodiment is formed such that the first shaft 22, the second hole 26, and the like are provided in the holder main member 3, and that the first hole 41, the second shaft 51, and the like are provided in the holder lid 5; however, the embodiment may be formed such that the first shaft 22, the second hole 26, and the like are provided in the holder lid 5, and that the first hole 41, the second shaft 51, and the like are provided in the holder main member 3.

The embodiment is formed such that the shaft lines of the first shaft 22, the first hole 41, the second shaft 51, and the second hole 26 correspond to the common shaft line A; however, another embodiment can be formed such that the aforementioned shaft lines do not correspond to each other. For example, the first shaft 22 may be received in the first hole 41 with looseness, and the second shaft 51 may be received in the second hole 26 with looseness.

The embodiment is formed such that the two support walls 38 are projected on a rear face of the lid plate portion 38; however, there may be concaved a concave groove which can receive the first shaft 22 on the rear face of the lid plate portion 38, and end walls disposed on both end portions of the concave groove may be support walls (support portions).

In the embodiment, an example wherein the hinge structure according to the present invention is applied to the connector holder 1 has been explained; however, the hinge structure according to the present invention can be applied to known various connection structures such as, for example, a connection portion (a hinge portion) of a door or a window, a bent portion (a hinge portion) of a foldable plate material, and the like.

EXPLANATION OF SYMBOLS

1 . . . a connector holder, 3 . . . a holder main member (a first member), 4 . . . a hinge structure, 5 . . . a holder lid (a second member), 7 . . . a main member side portion, 8 . . . a lid side portion, 11 . . . a base plate portion, 13 . . . a holding portion, 21 . . . a shaft support portion, 22 . . . a first shaft, 23 . . . an end potion, 24 . . . a first end face, 26 . . . a second hole, 27 . . . a second hole bottom face, 29 . . . a second groove, 31 . . . a second-groove bottom portion, 32 . . . a locking convex portion, 37 . . . a lid plate portion, 38 . . . a support wall (a support portion), 39 . . . a side face, 41 . . . a first hole, 42 . . . a first-hole bottom face, 45 . . . a first groove, 49 . . . a first-groove bottom face, 51 . . . a second shaft, 55 . . . a rib, 63 . . . a locking projection, 71 . . . a locking convex portion, 73 and 74 . . . convex portions, and A . . . a shaft line

What is claimed is:

1. A hinge structure for rotatably connecting a first member and a second member to each other, comprising:

a first shaft adapted to be provided in the first member, wherein an end portion thereof becomes a free end;

a support portion adapted to be provided in the second member to support the first shaft;

a bottomed first hole concaved on a side face of the support portion, and rotatably receiving the end portion of the first shaft;

a second shaft projecting from a bottom portion of the first hole;

a second hole concaved on an end face of the first shaft, and rotatably receiving an end portion of the second shaft;

a first groove concaved on the side face of the support portion, extending in a radial direction of the first hole from the first hole, and opening at an end portion thereof; and a second groove concaved on the end face of the first shaft, extending in a radial direction of the second hole from the second hole, and opening at an end portion thereof, wherein when the first member and the second member are assembled to each other, the first shaft passes through the first groove to be disposed in the first hole, and the second shaft passes through the second groove to be disposed in the second hole.

2. A hinge structure according to claim 1, further comprising a locking convex portion protruding from a bottom portion of the second groove, and locking an edge portion of the second shaft.

3. A hinge structure according to claim 1, wherein the first groove has one portion having a width smaller than a diameter of the first shaft, and the first groove elastically deforms to allow the first shaft to pass through.

4. A hinge structure according to claim 1, wherein the second groove has one portion having a width smaller than a diameter of the second shaft, and the second groove elastically deforms to allow the second shaft to pass through.

5. A hinge structure according to claim 1, further comprising a rib projecting from the bottom portion of the first hole, and slidingly contacting the end face of the first shaft.

6. A hinge structure according to claim 1, wherein the first shaft, the second shaft, the first hole, and the second hole are disposed on one shaft line.

* * * * *